US012108782B2

(12) United States Patent
Bray et al.

(10) Patent No.: US 12,108,782 B2
(45) **Date of Patent: *Oct. 8, 2024**

(54) APPARATUS AND METHOD FOR MANUFACTURING TOBACCO INDUSTRY PRODUCTS

(71) Applicant: British American Tobacco (Investments) Limited, London (GB)

(72) Inventors: Andrew Jonathan Bray, London (GB); Sam Whiffen, London (GB); Gerhard Le Roux, Paarl (ZA)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/085,895

(22) Filed: Dec. 21, 2022

(65) Prior Publication Data

US 2023/0129269 A1 Apr. 27, 2023

Related U.S. Application Data

(62) Division of application No. 16/301,586, filed as application No. PCT/GB2017/051477 on May 25, 2017, now Pat. No. 11,540,558.

(30) Foreign Application Priority Data

May 27, 2016 (GB) ..... 1609407

(51) Int. Cl.
*A24C 5/47* (2006.01)

(52) U.S. Cl.
CPC ..... *A24C 5/478* (2013.01); *A24C 5/471* (2013.01); *A24C 5/472* (2013.01); *A24C 5/473* (2013.01)

(58) Field of Classification Search
CPC ..... A24C 5/478
See application file for complete search history.

(56) References Cited

U.S. PATENT DOCUMENTS 1,908,771 A 5/1933 Lied
2,840,164 A 6/1958 Rudszinat
(Continued)

FOREIGN PATENT DOCUMENTS

CH 486855 1/1967
DE 524532 4/1931
(Continued)

OTHER PUBLICATIONS

European Search Report for corresponding application EP 21 158 940.3; Report dated Mar. 2, 2022.
(Continued)

*Primary Examiner* — Russell E Sparks
(74) *Attorney, Agent, or Firm* — CANTOR COLBURN LLP

(57) ABSTRACT

An apparatus for use in the manufacture of tobacco industry products (TIPs), including a rotatable drum having a plurality of flutes formed in a curved outer surface of the drum to receive axially-aligned components of a TIP, a roll hand having a contact surface facing and spaced from the outer surface of the drum to define a space, between the contact surface and the outer surface, within which space components of a TIP are rollable upon rotation of the drum, and a kicker bar disposed adjacent to the roll hand and having a contact edge facing and spaced from the outer surface of the drum, where at least one of the roll hand contact surface, kicker bar contact edge and drum outer surface includes a groove extending in a substantially circumferential direction of the drum and configured to least partially receive one or more of the TIP components as the drum rotates.

12 Claims, 10 Drawing Sheets

(56) References Cited

U.S. PATENT DOCUMENTS

| | | | | |
|---|---|---|---|---|
| 3,001,528 | A | 9/1961 | Schubert | |
| 3,176,694 | A | 4/1965 | Kaeding | |
| 3,228,512 | A | 1/1966 | Rudzinat | |
| 3,400,857 | A | 9/1968 | Schubert | |
| 3,478,632 | A | 11/1969 | Schmermund | |
| 4,020,852 | A | 5/1977 | Baker | |
| 4,023,577 | A | 5/1977 | Preston | |
| 4,112,954 | A | 9/1978 | Preston | |
| 4,277,678 | A | 7/1981 | Wahle | |
| 4,665,930 | A | 5/1987 | Arthur | |
| 4,827,947 | A | 5/1989 | Hinz | |
| 5,632,285 | A | 5/1997 | Dahlgrun | |
| 5,984,851 | A | 11/1999 | Irikura | |
| 6,302,113 | B1 | 10/2001 | Ozeray | |
| 6,425,400 | B1 | 7/2002 | Krause | |
| 11,252,990 | B2 * | 2/2022 | Bray | A24C 5/471 |
| 11,540,558 | B2 * | 1/2023 | Bray | A24C 5/471 |
| 2015/0291301 | A1 | 10/2015 | Cadieux | |

FOREIGN PATENT DOCUMENTS

| | | | |
|---|---|---|---|
| DE | 667740 | C | 11/1938 |
| DE | 1188495 | | 3/1965 |
| DE | 2254971 | | 5/1974 |
| DE | 2517299 | A1 | 11/1975 |
| DE | 3705627 | A1 | 9/1988 |
| DE | 19718322 | A1 | 11/1998 |
| DE | 102005019681 | A1 | 11/2006 |
| DE | 102011083029 | A1 | 10/2012 |
| DE | 102013201854 | A1 | 8/2014 |
| EP | 0395280 | A2 | 10/1990 |
| EP | 0687424 | A1 | 12/1995 |
| EP | 1493338 | A1 | 1/2005 |
| EP | 1629734 | A1 | 3/2006 |
| EP | 2762014 | A2 | 8/2014 |
| EP | 2813153 | A1 | 12/2014 |
| EP | 3315032 | A1 | 5/2018 |
| GB | 469815 | | 8/1937 |
| GB | 746435 | | 3/1956 |
| GB | 785417 | | 10/1957 |
| GB | 797632 | | 7/1958 |
| GB | 872629 | | 2/1960 |
| GB | 833998 | | 5/1960 |
| GB | 970050 | | 9/1964 |
| GB | 998958 | | 7/1965 |
| GB | 1020796 | | 2/1966 |
| GB | 1121069 | | 7/1968 |
| JP | 07256051 | A | 10/1995 |
| JP | 2013247954 | A | 12/2013 |
| KR | 1020150111355 | A | 10/2015 |
| WO | 9960874 | A1 | 12/1999 |
| WO | 2013146528 | A1 | 10/2013 |
| WO | 2014118309 | A1 | 8/2014 |

OTHER PUBLICATIONS

International Preliminary Report of Patentability for corresponding application PCT/GB2017/051474 filed May 25, 2017; Mail date Sep. 6, 2018.

International Preliminary Report on Patentability for corresponding application PCT/GB2017/051449 filed May 24, 2017; Report dated Sep. 6, 2018.

International Preliminary Report on Patentability for corresponding application PCT/GB2017/051477 filed May 25, 2017; Mail date Sep. 6, 2018.

International Search Report for corresponding application PCT/GB2017/051177 filed Apr. 27, 2017; Mail date Jul. 14, 2017.

International Search Report for corresponding application PCT/GB2017/051449 filed May 24, 2017; Mail date Aug. 7, 2017.

International Search Report for corresponding application PCT/GB2017/051474 filed May 25, 2017; Mail date Aug. 9, 2017.

International Search Report for corresponding application PCT/GB2017/051477 filed May 25, 2017; Mail date Aug. 10, 2017.

Written Opinion of the International Search Authority for corresponding application PCT/GB2017/051177 filed Apr. 27, 2017; Mail date Jul. 14, 2017.

Written Opinion of the International Searching Authority for corresponding application PCT/GB2017/051449 filed May 24, 2017; Mail date Aug. 7, 2017.

Written Opinion of the International Searching Authority for corresponding application PCT/GB2017/051474 filed May 25, 2017; Mail date Aug. 9, 2017.

Written Opinion of the International Searching Authority for corresponding application PCT/GB2017/051477 filed May 25, 2017; Mail date Aug. 10, 2017.

* cited by examiner

APPARATUS AND METHOD FOR MANUFACTURING TOBACCO INDUSTRY PRODUCTS

CROSS REFERENCE TO RELATED APPLICATIONS

This application is a divisional of U.S. patent application Ser. No. 16/301,586, which was filed on Nov. 14, 2018 as the U.S. National Stage of International Patent Application Number PCT/GB2017/051477, which was filed on May 25, 2017 claiming priority to Great Britain Patent Application Number 16301586 filed on May 27, 2016, all of which said applications are hereby incorporated by reference in their entirety.

TECHNICAL FIELD

Embodiments of the invention relate to an apparatus for manufacturing tobacco industry products, and to a method of use of such apparatus in the manufacture of tobacco industry products.

BACKGROUND

It is known to provide apparatuses for receiving, arranging and assembling components for the manufacture of tobacco industry products, such as smoking articles. Such apparatuses can include a series of drums that convey components along a manufacturing path as the drums rotate. Components are transferred from one drum to the next at a point where the circumferential surfaces of the drums are closest to each other. As the components are conveyed along the path they are subject to several processes, for example cutting, sliding, combining with other components, gluing, and rolling or wrapping with a paper patch. Cigarette components typically include filters, filter components and wrapped tobacco rods.

EP 2,762,014 discloses a conveyor drum for transporting rod shaped articles with pressure sensitive objects comprising receiving troughs with first groove shaped recess portions and second groove shaped recess portions.

DE 10 2011 083 029 discloses a rotary conveyor and method of conveying articles of the tobacco processing industry, the rotary conveyor having a substantially cylindrical shell and a plurality of vacuum pockets which can be acted on by a negative pressure for sucking the articles.

EP 1,629,734 discloses a device for rolling rod-like tobacco components comprising a front roll surface in a web wheel. A front roll channel is defined between the front roll surface and the roll surface of a roll conveyor.

SUMMARY

In accordance with some embodiments described herein, there is provided an apparatus for use in the manufacture of tobacco industry products, the apparatus comprising a rolling unit comprising:

- a rotatable drum having a plurality of flutes formed in a curved outer surface of the drum to receive axially-aligned components of a tobacco industry product;
- a roll hand having a contact surface facing and spaced from the outer surface of the drum to define a space, between the contact surface and the outer surface, within which space components of a tobacco industry product are rollable across the outer surface upon rotation of the drum; and

- a kicker bar disposed adjacent to the roll hand and having a contact edge facing and spaced from the outer surface of the drum;
- wherein at least one of the roll hand contact surface, kicker bar contact edge and drum outer surface includes a groove extending in a substantially circumferential direction of the drum and configured to least partially receive one or more of the tobacco industry product components as the drum rotates.

In some embodiments, at least one of the roll hand contact surface, kicker bar contact edge and drum outer surface includes two grooves extending in a substantially circumferential direction of the drum, and wherein the two grooves are spaced apart in an axial direction of the drum.

In one embodiment, the kicker bar contact edge and the roll hand contact surface both include said groove(s).

In another embodiment, the drum outer surface and the roll hand contact surface both include said groove(s).

In another embodiment, the drum outer surface and the kicker bar contact edge both include said groove(s).

In another embodiment, the drum outer surface, the kicker bar contact edge and the roll hand contact surface all include said groove(s).

In yet another embodiment, only the drum outer surface includes said groove(s).

The kicker bar contact edge may include a groove and the roll hand contact surface may include a groove, and wherein a base surface of the groove in the kicker bar contact edge may be level with a base surface of the groove in the roll hand contact surface.

Alternatively, the kicker bar contact edge may include a groove and the roll hand contact surface may include a groove, and wherein a base surface of the groove in the kicker bar contact edge may be off-set from a base surface of the groove in the roll hand contact surface.

In some examples the kicker bar contact edge may include a groove, and wherein a depth of the groove in the kicker bar contact edge may vary from a side of the kicker bar remote from the roll hand to a side of the kicker bar proximate the roll hand.

The kicker bar contact edge may include a groove and the roll hand contact surface may include a groove, and wherein a base surface of the groove in the kicker bar contact edge may be level with a base surface of the groove in the roll hand contact surface at the side of the kicker bar proximate the roll hand, and may be off-set from the base surface of the groove in the roll hand contact edge at the side of the kicker bar remote from the roll hand.

In some examples, the kicker bar is a separate component to the roll hand and is fixedly secured to the roll hand.

Additionally, a position of the kicker bar relative to the roll hand may be adjustable.

In accordance with some embodiments described herein, there is provided a smoking article assembly machine comprising the apparatus described above.

In accordance with some embodiments described herein, there is provided a method of manufacturing tobacco industry products using apparatus for manufacturing tobacco industry products, the apparatus comprising a rolling unit having a rotatable drum having a plurality of flutes formed in a curved outer surface of the drum, a roll hand having a contact surface facing and spaced from the outer surface of the drum to define a space between the contact surface and the outer surface within which space components of a tobacco industry product are rollable across the outer surface upon rotation of the drum, and a kicker bar disposed adjacent to the roll hand and having a contact edge facing and spaced from the outer surface of the drum, at least one of the roll hand contact surface, kicker bar contact edge and drum outer surface including a groove extending in a substantially circumferential direction of the drum, the method comprising transferring a plurality of components of tobacco industry products to the drum, receiving the plurality of components in axial alignment in the flutes, rotating the drum relative to the kicker bar and roll hand so that the components of the tobacco industry products engage the kicker bar and roll hand, and at least one of the components of the tobacco industry products being at least partially received in the groove(s) as the drum rotates.

In some embodiments, the kicker bar contact edge and the roll hand contact surface both include said groove(s), and at least one of the components of the tobacco industry products is at least partially received in the groove(s) in the kicker bar contact edge and the roll hand contact surface as the drum rotates.

In other embodiments, the drum outer surface and the roll hand contact surface both include said groove(s), and at least one of the components of the tobacco industry products is at least partially received in the groove(s) in the drum outer surface and the roll hand contact surface as the drum rotates.

In other embodiments, the drum outer surface and the kicker bar contact edge both include said groove(s), and at least one of the components of the tobacco industry products is at least partially received in the groove(s) in the drum outer surface and the kicker bar contact edge as the drum rotates.

In other embodiments, the drum outer surface, the kicker bar contact edge and the roll hand contact surface all include said groove(s), and at least one of the components of the tobacco industry products is at least partially received in the groove(s) in the drum outer surface, the kicker bar contact edge and the roll hand contact surface as the drum rotates.

In other embodiments, the drum outer surface includes said groove(s), and at least one of the components of the tobacco industry products is at least partially received in the groove(s) in the drum outer surface as the drum rotates.

The components of tobacco industry products may comprises a plurality of filter components, one of the plurality of filter components may have a hardness different to another of the plurality of filter components, and the filter components having a greater hardness may be at least partially received in the groove(s) as the drum rotates.

In some embodiments the kicker bar is a separate component to the roll hand and is fixedly secured to the roll hand, the method comprising adjusting the position of the kicker bar relative to the roll hand to adjust an off-set distance between the contact edge of the kicker bar and the contact surface of the roll hand.

BRIEF DESCRIPTION OF THE DRAWINGS

Embodiments of the invention will now be described, by way of example only, with reference to the accompanying drawings in which.

DETAILED DESCRIPTION

Figure 1:
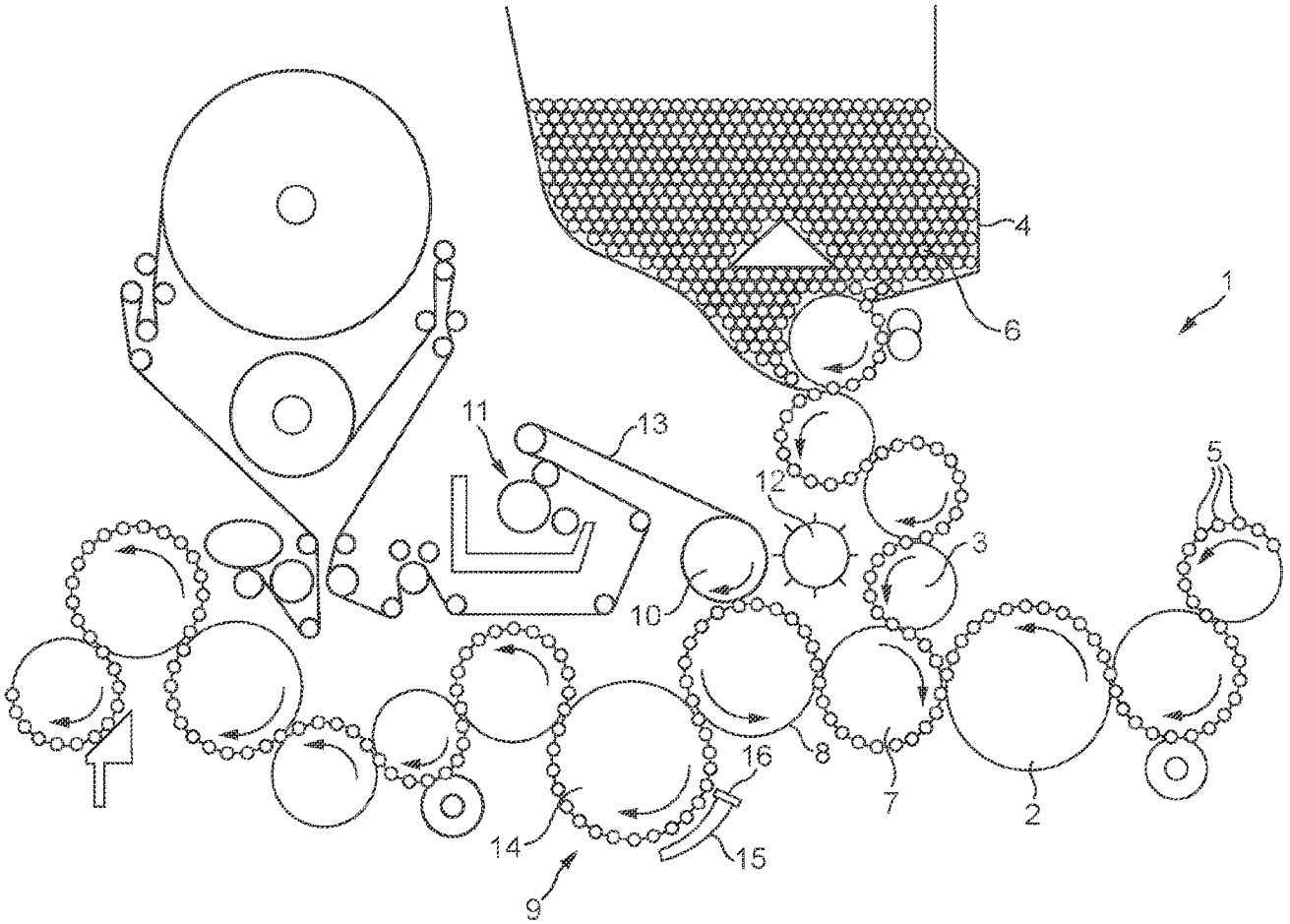
FIG. 1 shows a schematic illustration of a tobacco industry product manufacturing apparatus comprising an embodiment of the invention.

FIG. 1 schematically shows a part of a tobacco industry product manufacturing apparatus 1 comprising a tobacco industry product manufacturing apparatus of one embodiment of the present invention. Hereafter, the description will refer to such tobacco industry products as "smoking articles" for brevity. The apparatus 1 includes a tobacco rod feed drum 2 and a filter component feed drum 3. The tobacco rod feed drum 2 receives wrapped tobacco rods 5 that are travelling in a direction transverse to their length (i.e. sideways) in flutes formed in the peripheral surface of the tobacco rod feed drum 2. The filter component feed drum 3 receives filter components 6 from a hopper 4 in flutes formed in the peripheral surface of the filter component feed drum 3. In the apparatus 1 shown, a single filter component feed drum 3 and single hopper 4 is shown. However, the apparatus 1 may include multiple filter component feed drums 3 and/or multiple hoppers 4, in order that different configurations or types of filter components may be combined and assembled into smoking articles being manufactured. Alternatively, the single hopper 4 may be configured to provide different configurations of filter components 6 to the filter component feed drum 3.

The filter component feed drum 3 and the tobacco rod feed drum 2 feed filter components 6 and tobacco rods 5, respectively, onto a combining drum 7, such that the filter components 6 and tobacco rods 5 are axially aligned in flutes on the peripheral surface of the combining drum 7, ready to be wrapped to form an assembled smoking article.

As shown in FIG. 1, from the combining drum 7 the tobacco rods 5 and filter components 6 are transferred onto a tipping drum 8 where they are provided with a tipping paper patch 22 (see FIG. 2) before being transferred to a rolling unit 9 that rolls the tipping paper patch 22 around the tobacco rods 5 and filter components 6 to form two joined and assembled smoking articles 21 in back-to-back arrangement. The tipping paper patch is supplied to the tipping drum 7 by a tipping paper suction drum 10.

A web 13 of tipping paper passes through an adhesive applicator 11 that applies adhesive to one surface of the tipping paper web 13. The tipping paper web 13 is then received on the tipping paper suction drum 10, which uses suction to hold the web 13 of tipping paper against the peripheral surface of the tipping paper suction drum 10. A cutting unit 12 cuts the web 13 of tipping paper into patches on the tipping paper suction drum 10 and the patches are then transferred to the tobacco rods 5 and filter components 6 on the tipping drum 8.

In one example, the cutting unit 12 comprises a crush cutter. In this case, the cutting unit 12 comprises a rotary blade and the tipping paper suction drum 10 acts as an anvil against which the tipping paper web 13 is cut by the rotary blade, in a transverse direction (i.e. across the web 13), to form patches of tipping paper.

In an alternative embodiment, the cutting unit 12 uses a shear cutter to cut the web 13. In this case, the tipping paper suction drum 10 comprises edges that act with blades of the cutting unit 12 to shear cut the tipping paper web 13.

The cutting unit 12 may have several rotary blades which protrude from a shaft in a radial direction so that as the shaft rotates the blades successively engage the tipping paper suction drum 10 and cut the web 13 in a transverse direction (i.e. in the axial direction of the tipping paper suction drum 10 and cutting unit 12).

The cut patches of tipping paper 22 on the tipping paper suction drum 10 already have adhesive applied to their outwards facing surface, so at the position where the tipping paper suction drum 10 rotates closest to the tipping drum 8 the suction acting on the tipping paper patches 22 is released and the patches are transferred from the tipping paper suction drum 10 to the tipping drum 8, specifically onto the tobacco rods 5 and filter components 6. The adhesive anchors the tipping paper patches to the tobacco rods 5 and filter components 6.

The tipping drum 8 then transfers the tobacco rods 5 and filter components 6 and the tipping paper patch 22 into the rolling unit 9 that rolls the tipping paper patch 22 around the tobacco rods 5 and filter components 6 to form smoking articles. The rolling unit 9 comprises a rolling drum 14 that receives and carries the tobacco rods 5 and filter components 6 and the tipping paper patch 22 past a stationary roll hand 15 and kicker bar 16 (described in more detail below).

Figure 3:
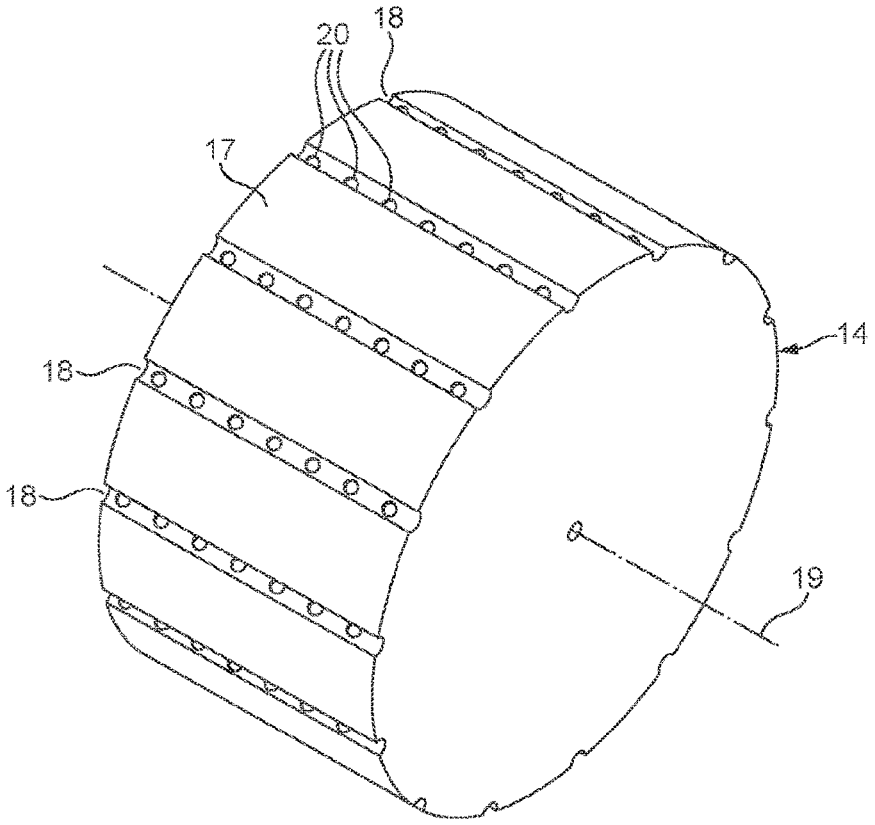
FIG. 3 shows a rolling drum of the tobacco industry product manufacturing apparatus of FIG. 1.

The rolling drum 14 of a first exemplary embodiment is shown in more detail in FIG. 3, and comprises a cylindrical drum 14 having a curved outer surface 17 with a plurality of flutes 18 formed in the curved outer surface 17. The drum 14 is adapted to rotate about an axis 19. The flutes 18 are sized to receive and retain tobacco and/or filter components as the drum 14 rotates. The flutes 18 extend in a direction parallel to the axis of rotation 19 of the drum 14.

Each flute 18 includes at least one suction hole 20 that holds the components in the flute 18 when suction is provided to the suction hole 20. In this example, each flute 18 includes several suction holes 20, so that multiple components can be retained in the flute 18. However, multiple suction holes 20 may be provided to retain a single elongate component. Turning off the suction applied to the suction holes 20 will allow the components to leave the flute 18.

A suction manifold (not shown) can be used to provide suction to the suction holes 20 during pre-defined portions of the rotation of the drum 14, and to switch off the suction to the suction holes 20 in other pre-defined portions of the rotation of the drum 14.

The kicker bar 16 pushes the tobacco rods 5 and filter components 6 and the tipping paper patch 22 out of flutes 18 in the rolling drum 14 as the rolling drum 14 rotates them past the kicker bar 16. The tobacco rods 5 and filter components 6 and the tipping paper patch 22 are then rolled between the curved surface 17 of the rolling drum 14 and the roll hand 15, thereby wrapping the tipping paper patch 22 around the tobacco rods 5 and filter components 6 to join them together.

The rolled smoking articles are then conveyed by further drums for cutting into individual single length smoking articles, aligning, arranging and packaging.

Figure 2:
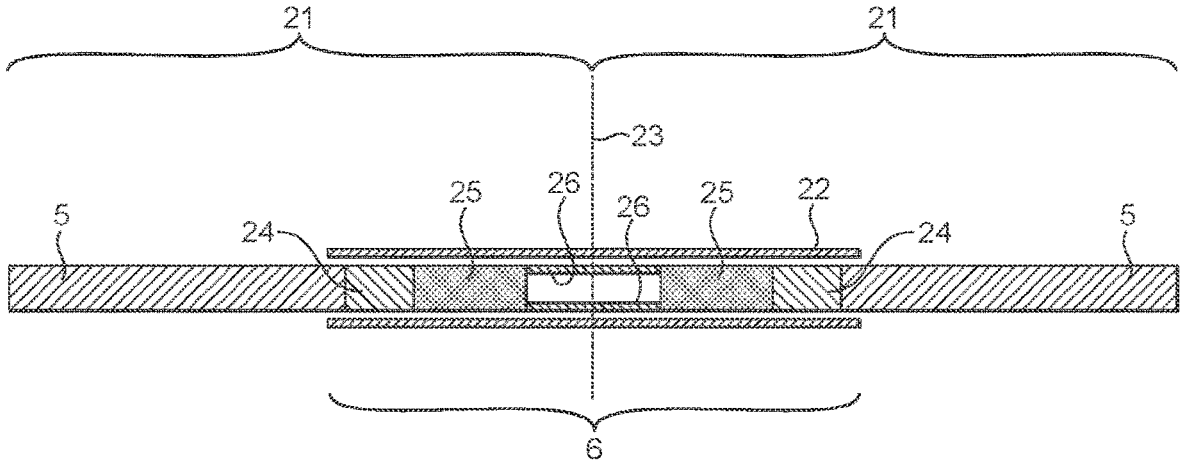
FIG. 2 shows a cross section of an example of a tobacco industry product manufactured by the apparatus of FIG. 1.

Referring to FIG. 2, two joined smoking articles 21 are manufactured together, as explained above, by arranging two tobacco rods 5 at either end of a double-length filter component 6 on the combining drum 7. The tobacco rods 5 and filter component 6 are joined together by wrapping a tipping paper patch 22 about them, and then cutting through the filter component 6 along line 23 to separate the two smoking articles 21.

Figure 4:
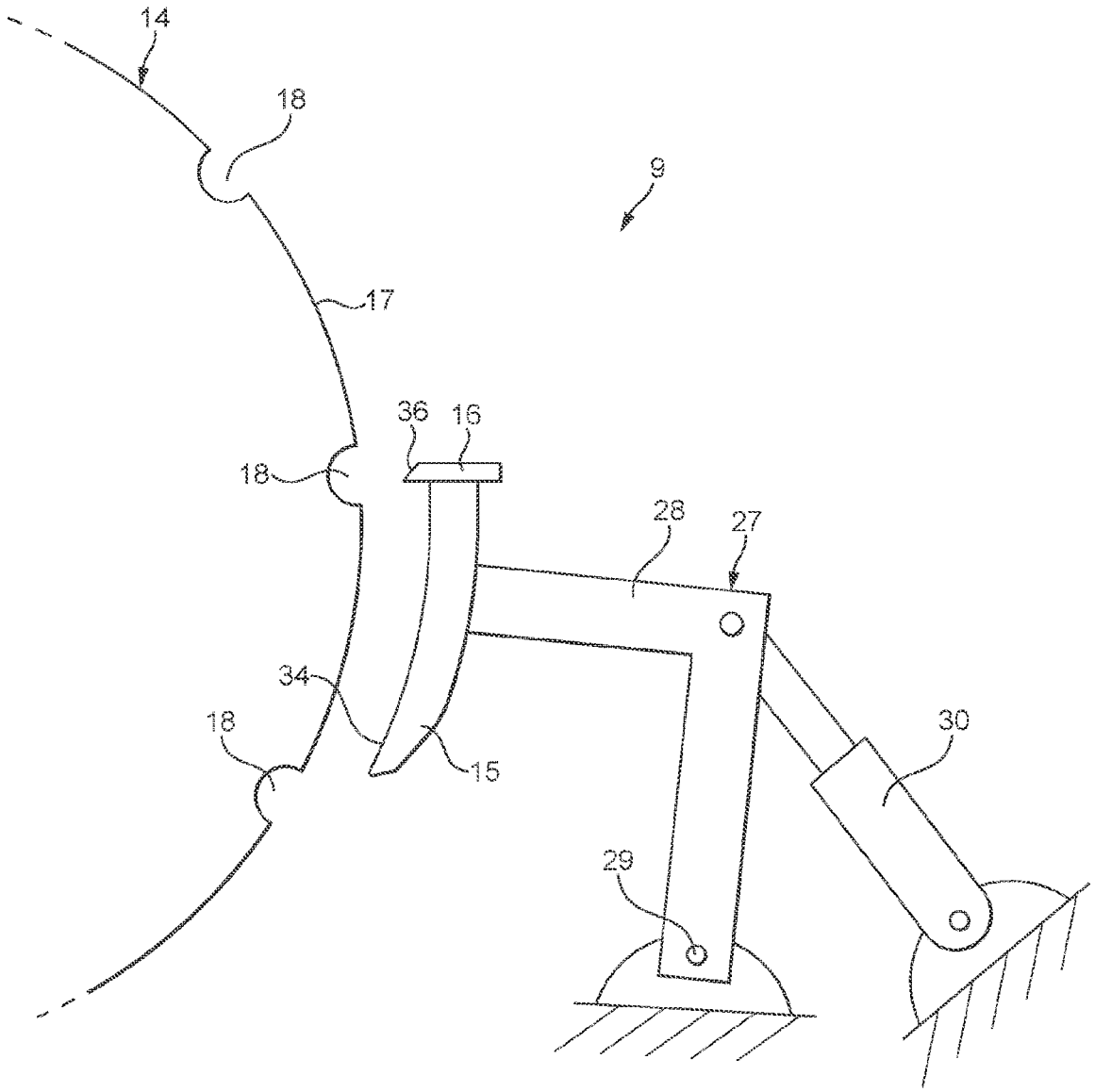
FIG. 4 shows an enlarged view of a rolling unit of the apparatus of FIG. 1.

The roll hand 15 and kicker bar 16 are mounted on a support mechanism 27. The support mechanism 27 is configured to hold the roll hand 15 and kicker bar 16 in a fixed position during operation of the apparatus 1. In the exemplary embodiment shown, the support mechanism 27 comprises a bracket 28 fixedly secured to the roll hand 15 and mounted about a pivot point 29 to a fixed portion of the apparatus 1. A piston 30 is attached at one end to a portion of the bracket 28 and at the other end to a fixed portion of the apparatus 1. The piston 30 is provided to enable the roll hand 15 and kicker bar 16 to be moved away from the rolling drum 14 for servicing or maintenance, but in use of the apparatus 1, holds the roll hand 15 and kicker bar 16 in a fixed operative position (shown in FIG. 4). The roll hand 15 and kicker bar 16 are thereby not moveable away from or towards the rolling drum 14 during operation of the apparatus 1.

As explained above, filter components 6, tobacco rods 5, tipping paper patches 22, and wrapped smoking articles 21, collectively 'components', are transferred between successive drums as the components travel through the apparatus 1 to manufacture smoking articles 21. The components 5, 6, 21, 22 are transferred from one drum to the next at the point where the peripheral surfaces of the drums are closest, and at these transfer points the components 5, 6, 21, 22 are in contact with the flutes of both drums.

The drums are arranged such that at each transfer point, the components 5, 6, 21, 22 are smoothly and reliably transferred. That is, the components 5, 6, 21, 22 are placed into the flutes of the downstream drum so that the suction applied in the flute can take effect on the components 5, 6, 21, 22 before the upstream drum moves away. During transfer, suction acts on the components 5, 6, 21, 22 from either the upstream drum, the downstream drum, or, for short time, both the upstream and downstream drums.

In the rolling unit 9, as the tobacco rods 5 and filter components 6 pass between the roll hand 15 and kicker bar 16, the kicker bar 16 initially engages the tobacco rods 5 and filter components 6, compressing them slightly to ensure they are reliably pushed out of their flute 18 in the rolling drum 14. As described above, as the rolling drum 14 continues to rotate, the tobacco rods 5 and filter components 6 are rolled between the rotating rolling drum 14 and the stationary roll hand 15 to become wrapped with the tipping paper patch 22. The spacing between the kicker bar 16 and the roll hand 15 and the curved surface 17 of the rolling drum 14 is accurately set to ensure the correct degree of initial compression of the tobacco rods 5 and filter components 6 in the flute 18, and correct contact pressure of the tobacco rods 5 and filter components 6 between the curved surface 17 rolling drum 14 and the roll hand 15. The kicker bar 16 and roll hand 15 are fixedly connected, or are formed as one component, and during use, remain in a fixed position whilst the rolling drum 14 rotates. In a conventional apparatus, the roll hand comprises a continuous curved surface and the kicker bar comprises a continuous elongate bar.

In various examples within the scope of the invention, each filter component 6 may comprise one or more filter segments. For example, the filter rod 6 may be formed of any combination of cellulose acetate segments, plasticised cellulose acetate segments, paper segments, non-wrapped cellulose acetate segments, plastic components, ceramic components, or metallic segments. These filter segments are generally cylindrical and/or tubular, and may have a cylindrical outer surface that fits within the flutes of the drums and can be rolled by the rolling drum 14 to create a wrapped smoking article. The filter segments may each have a wrapper, typically called a plug wrap, which holds the material of the filter segment in the desired shape before the filter segment is provided to the apparatus 1 of FIG. 1.

The smoking articles shown in FIG. 2 and made on the apparatus of FIG. 1 may be cigarettes. Alternatively, the smoking articles may be products which heat tobacco without burning that tobacco to release a vapour. Yet further, the smoking articles may be products of a device that heats tobacco without burning that tobacco to release a vapour. Alternatively, they may be any other kind of smoking article that is manufactured on apparatus having a series of drums.

In the exemplary embodiment, the smoking article shown in FIG. 2 comprises a wrapped tobacco rod 5 which comprises a tobacco material wrapped in a wrapper, for example a paper wrapper. The smoking article also comprises a filter component 6. In this example, the filter component 6 comprises a first filter segment 24 being made of plasticized cellulose acetate through which smoke or vapour can pass and which removes constituents from the smoke or vapour. A second segment 25 of the filter component 6 comprises a tubular member made from plastics, the plastics tubular member having passages therethrough to allow smoke or vapour to pass through the filter section. A third filter segment 26 comprises a tubular member made of paper.

As is apparent from FIG. 2, each filter component 6 supplied to the apparatus of FIG. 1 is symmetrical so that after the filter component 6 is cut along line 23 there are two identical smoking articles 21.

It will be appreciated that other filter sections have different combinations of components, and it is possible to arrange such components in a multitude of ways using drums that received, move and position components in the same flute so that they can be wrapped to join them into smoking articles.

The filter component 6 is attached to the end of a tobacco rod 5 by a tipping paper patch 22 that circumscribes the join between the filter component 6 and tobacco rod 5. The tipping paper patch 22 is adhered to the outer surface of the filter component 6 and the tobacco rod 5. The tipping paper patch 22 may extend over the whole of the filter component 6 and partially over the tobacco rod 5. Alternatively, the tipping paper patch 22 may extend partially onto the filter component 6 and partially onto the tobacco rod 5.

As explained above, the smoking articles manufactured by the apparatus 1 of FIG. 1 may include components or segments having a high hardness, for example components made of plastic, ceramic or metal. In this case, during the rolling process in the rolling unit 9, such components are placed under pressure, such as by the kicker bar 16 to push them out of the flutes 18 in the rolling drum 14, and between the curved surface of the roll hand 15 and the curved surface 17 of the rolling drum 14. Such pressure may be accommodated by components which are deformable and/or resilient. However, if components are delicate, fragile, or brittle, then the components may be damaged, broken, or deformed by the pressure applied to the components. For example, a plastic component may be cracked or broken by the pressure. Furthermore, if the kicker bar 16 and/or roll hand 15 are set further away from the rolling drum to avoid damaging the harder components, the rolling unit 9 may not exert sufficient force to push the tobacco rods 5 and other filter components 6 out of the flutes 18 or roll them between the rolling drum surface 17 and roll hand 15 successfully or reliably. Yet further, passing hard rigid components between a fixed kicker bar 16/roll hand 15 and the rolling drum 14 of a conventional apparatus may force the roll hand 15 and kicker bar 16 away from the rolling drum 14, enlarging the spacing therebetween. As mentioned above, the clearance between the roll hand 15 and the kicker bar 16 is carefully set, and effective and reliable operation of the apparatus 1 is sensitive to this spacing. Therefore, unintentional enlargement of this spacing can be detrimental to the operation of the apparatus 1, for example, ineffective rolling of the filter component 6 and tobacco rod 5 with the tipping paper patch 22, or these components falling out of the gap between the rolling drum 14 and the roll hand 15.

Figure 5:
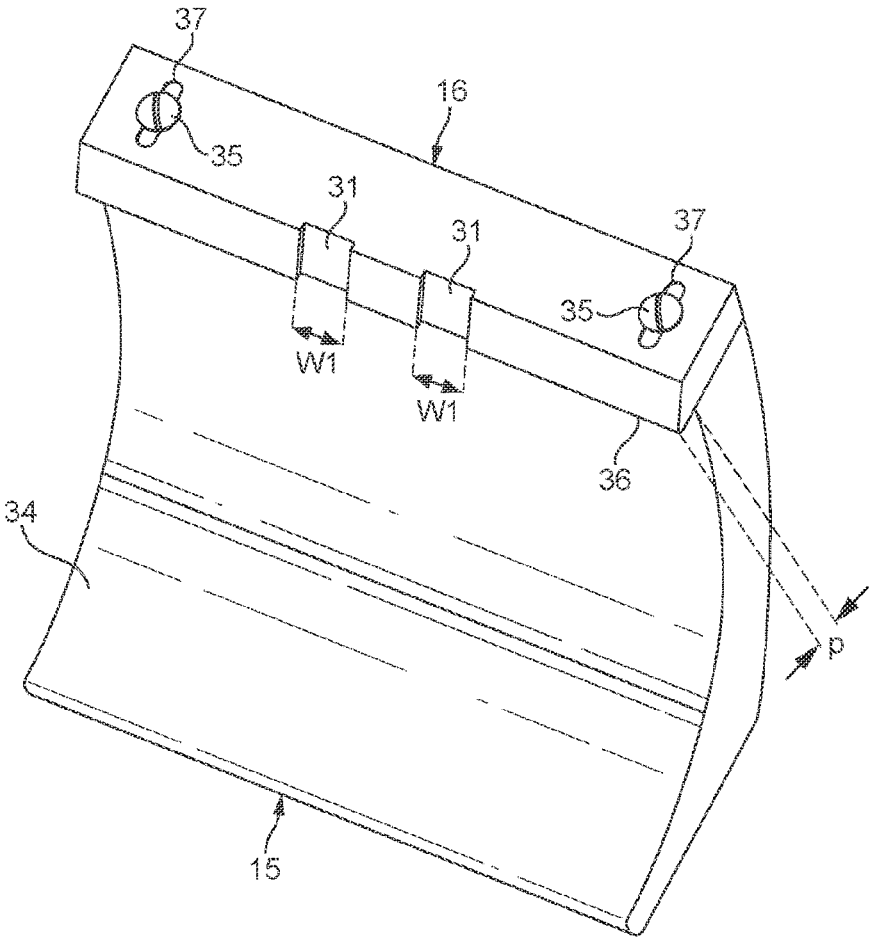
FIG. 5 shows an enlarged view of a roll hand and kicker bar of the rolling unit of FIG. 4.

In order to seek to avoid or mitigate the above problems and to accommodate smoking article components of differing hardnesses, the roll hand 15 and kicker bar 16 of an exemplary embodiment of the present invention are provided as illustrated in more detail in FIG. 5.

The roll hand 15 includes a curved contact surface 34 which, in use, faces the rolling drum 14 and presses against the tobacco rods 5 and filter components 6 as they are rolled between the roll hand 15 and the rotating rolling drum 14 to become wrapped with the tipping paper patch 22. In the exemplary embodiment shown, the kicker bar 16 is a separate component which is fixedly secured to the roll hand 15 during use of the apparatus 1. However, the kicker bar 16 may alternatively be formed integrally with the roll hand 15 within the scope of the invention. In the embodiment shown, the kicker bar 16 is secured to the roll hand 15 by mechanical fasteners 35, such as screws or bolts. The kicker bar 16 includes a contact edge 36 which, in use, is the part of the kicker bar 16 disposed closest to the rolling drum 14. The contact edge 36 is disposed closer to the rolling drum 14 than the curved contact surface 34 of the roll hand 15. The distance between the contact edge 36 and the rolling drum 14 affects how the tobacco rods 5 and filter components 6 are initially compressed and/or pushed out of the flutes 18. Also in the exemplary embodiment shown, the kicker bar 16 is adjustable relative to the roll hand 15. That is, a projection distance (see distance 'p' in FIG. 5) of the contact edge 36 of the kicker bar 16 from the curved contact surface 34 of the roll hand 15 can be adjusted and set. The kicker bar 16 includes adjustments slots 37 through which the mechanical fasteners 35 extend. The mechanical fasteners 35 can therefore be loosened, the kicker bar 16 adjusted by the distance permitted by the adjustment slots 37, and the mechanical fasteners 35 tightened to secure the kicker bar 16 with the desired projection distance 'p'.

The kicker bar 16 includes recesses 31 formed in the contact edge 36. The recesses 31 have a width 'w1' which corresponds to the length of the second segment 25 of the filter components 6, or which is slightly larger than the length of the second segment 25.

Figure 10:
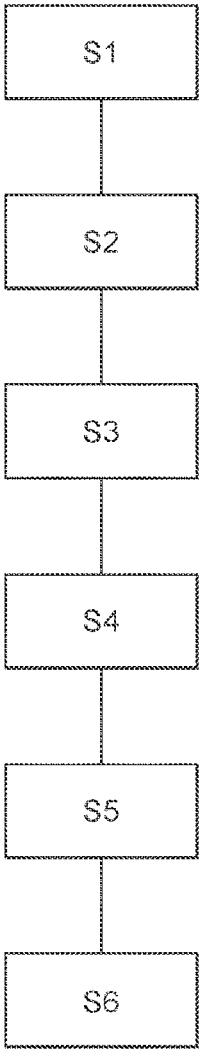
FIG. 10 shows a flow chart of a method of operation of the tobacco industry product manufacturing apparatus of an embodiment of the invention.

Operation of the rolling unit 9 of the apparatus 1 of the invention will now be described, with additional reference to the flow chart of FIG. 10. The tobacco rods 5 and filter components 6, together with the tipping paper patch 22, are transferred from the tipping drum 8 to the rolling drum 14 as described above, at step S1 of FIG. 10. The tobacco rods 5 and filter components 6 are received in axial alignment in a flute of the 18 of the rolling drum 14, at step S2. The tobacco rods 5 and filter components 6 reach and engage the kicker bar 16 as the rolling drum 14 rotates, at step S3. The filter components 6 and tobacco rods 5 contact the contact edge 36 of the kicker bar 16 and pressure is exerted on the tobacco rod 5 and filter components 6 to compress them and push them out of the flute 18 as described above.

The second segment 25 comprises a tubular member made from plastic having a higher hardness than the more compressible tobacco rod 5, first filter segment 24 made of plasticized cellulose acetate and third filter segment 26 made of paper. However, the second segments 25 are partially received within the recesses 31, at step S4, as the filter components 6 and tobacco rod 5 pass the kicker bar 16 and are pushed out of the flute 18 at step S5. The recesses 31 thereby accommodate the hard second segments 25 and so prevent the kicker bar 16 and roll hand 15 being pushed away from the rolling drum 14 and disrupting the spacing therebetween. This also prevents the kicker bar 16 damaging the second segments 25 through excessive compression.

Thereafter, the tobacco rods 5 and filter components 6, together with the tipping paper patch 22, pass the kicker bar 16 and are rolled between the curved outer surface 17 of the rolling drum 14 and the curved contact surface 34 of the roll hand 15 as described previously, at step S6.

Figure 6:
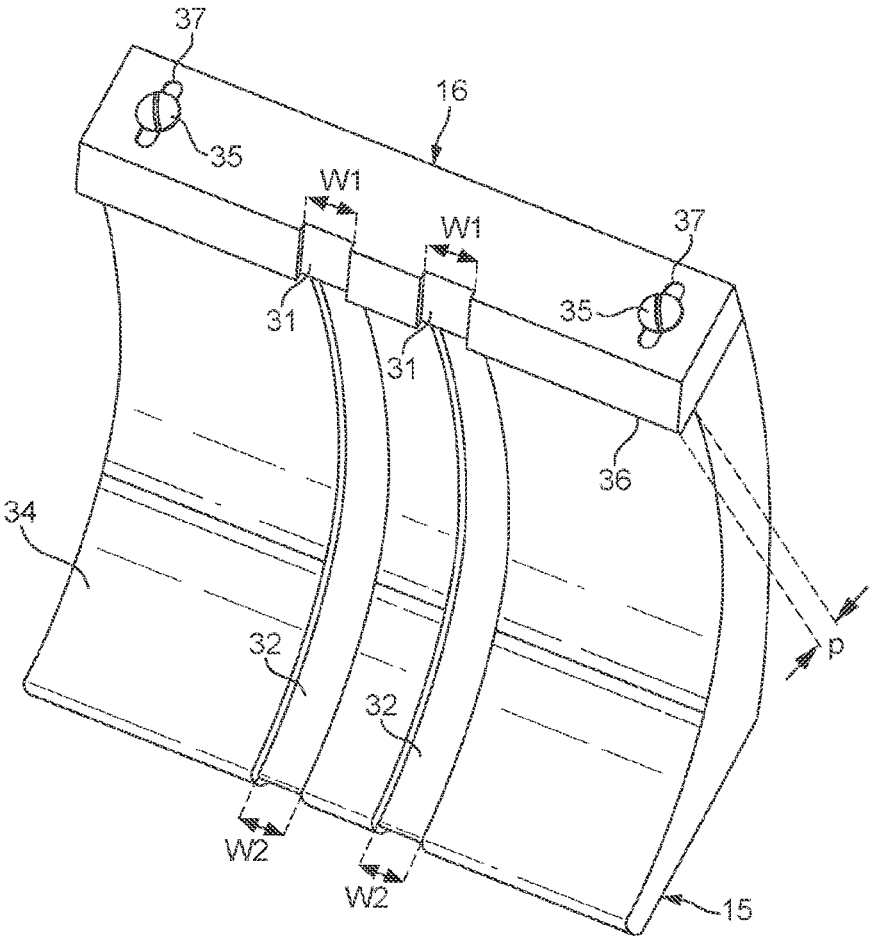
FIG. 6 shows an enlarged view of an alternative embodiment of a roll hand and kicker bar operable with the rolling unit of the apparatus of FIG. 1.

A roll hand 15 and kicker bar 16 of a first alternative exemplary embodiment of the invention are shown in FIG. 6, in which like features in common with the previous embodiment retain the same reference numerals. In this first alternative embodiment, the kicker bar 16 includes recesses 31 formed in the contact edge 36 as with the previous embodiment, the recesses 31 having a width 'w1' as before. A difference with the first alternative embodiment is that the curved contact surface 34 of the roll hand 15 includes a pair of shallow grooves 32. The grooves 32 extend in a circumferential direction of the rolling drum 14 and are positioned in alignment with the recesses 31 in the kicker bar 16. The grooves 32 have a width 'w2' which corresponds to the length of the second segment 25 of the filter components 6, or which is slightly larger than the length of the second segment 25.

Operation of the rolling unit 9 of the apparatus 1 of the first alternative embodiment of the invention will now be described. The tobacco rods 5 and filter components 6, together with the tipping paper patch 22, are transferred from the tipping drum 8 to the rolling drum 14 and, as the rolling drum 14 rotates, the contact edge 36 of the kicker bar 16 exerts pressure on the tobacco rods 5 and filter components 6 to compress them and push them out of the flute 18, as described above. The harder second segments 25 are partially received within the recesses 31 in kicker bar 16 and thereby prevent the kicker bar 16 and roll hand 15 being pushed away from the rolling drum 14, or damaging the second segments 25 through excessive compression, as with the previous embodiment of the invention.

Once past the kicker bar 16, the tobacco rods 5 and filter components 6, together with the tipping paper patch 22 are rolled between the curved outer surface 17 of the rolling drum 14 and the curved contact surface 34 of the roll hand 15. However, the harder second segments 25 are partially received within the grooves 32 in the roll hand 15. This further accommodation of the hard second segments 25 in the curved contact surface 34 of the roll hand 15 further helps towards preventing the roll hand 15 being pushed away from the rolling drum 14 and disrupting the spacing therebetween, and/or preventing the rolling hand 15 damaging the second segments 25 through excessive compression during rolling. It also helps enable a similar pressure be applied on all filter components 6 of varying hardnesses during the rolling process to help achieve consistent rolling performance.

Figure 7:
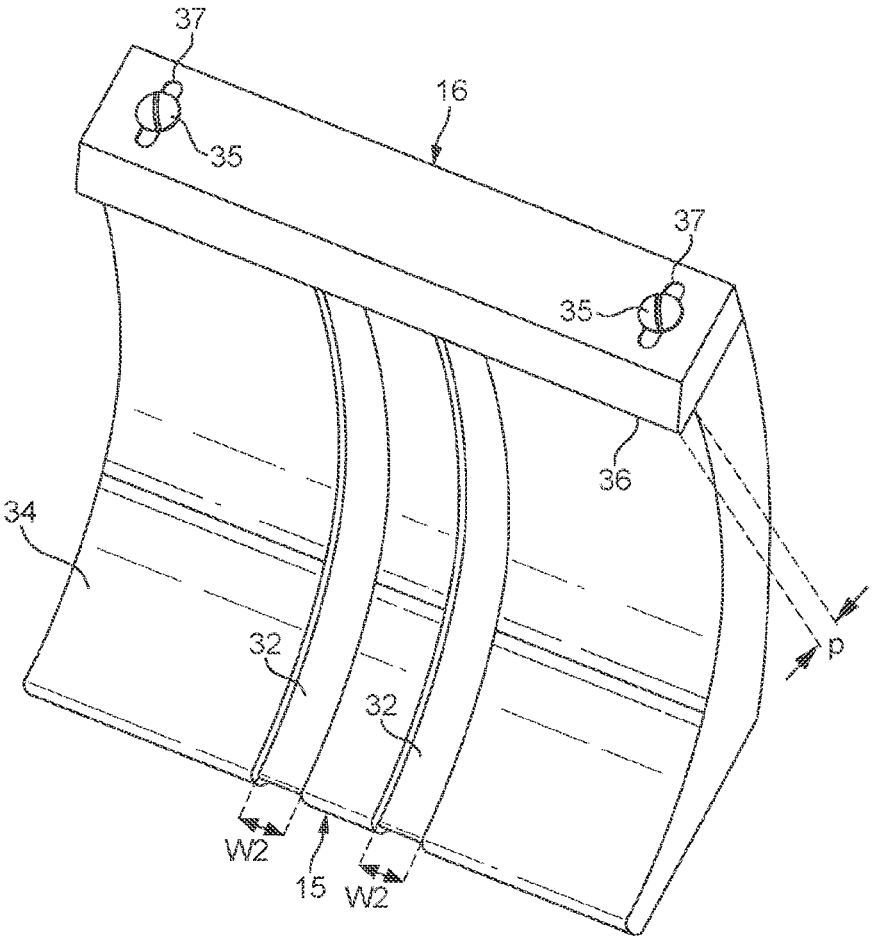
FIG. 7 shows an enlarged view of a further alternative embodiment of a roll hand and kicker bar operable with the rolling unit of the apparatus of FIG. 1.

A roll hand 15 and kicker bar 16 of a second alternative exemplary embodiment of the invention are shown in FIG. 7, in which like features in common with the previous embodiments retain the same reference numerals. In this second alternative embodiment, the curved contact surface 34 of the roll hand 15 includes a pair of shallow grooves 32 as described previously. The grooves 32 extend in a circumferential direction of the rolling drum 14 and have a width 'w2' which corresponds to the length of the second segment 25 of the filter components 6, or which is slightly larger than the length of the second segment 25. A difference over the previous embodiments is that the kicker bar 16 does not include recesses in the contact edge 36. The projection distance 'p' may be set at or close to a minimal amount necessary to ensure the tobacco rods 5 and filter components 6 are pushed out of the flute 18, without damaging the harder second filter segments 25.

Operation of the rolling unit 9 of the apparatus 1 of the second alternative embodiment of the invention will now be described. The tobacco rods 5 and filter components 6, together with the tipping paper patch 22, are transferred from the tipping drum 8 to the rolling drum 14 and, as the rolling drum 14 rotates, the contact edge 36 of the kicker bar 16 exerts pressure on the tobacco rods 5 and filter components 6 to push them out of the flute 18. Once past the kicker bar 16, the tobacco rods 5 and filter components 6, together with the tipping paper patch 22 are rolled between the curved outer surface 17 of the rolling drum 14 and the curved contact surface 34 of the roll hand 15. The harder second segments 25 are partially received within the grooves 32 in the roll hand 15 to help prevent the roll hand 15 being pushed away from the rolling drum 14 and disrupting the spacing therebetween, and/or to prevent the roll hand 15 damaging the second segments 25 through excessive compression during rolling. The grooves 32 also help enable a similar pressure be applied on all filter components 6 of varying hardnesses during the rolling process to help achieve consistent rolling performance.

Figure 8:
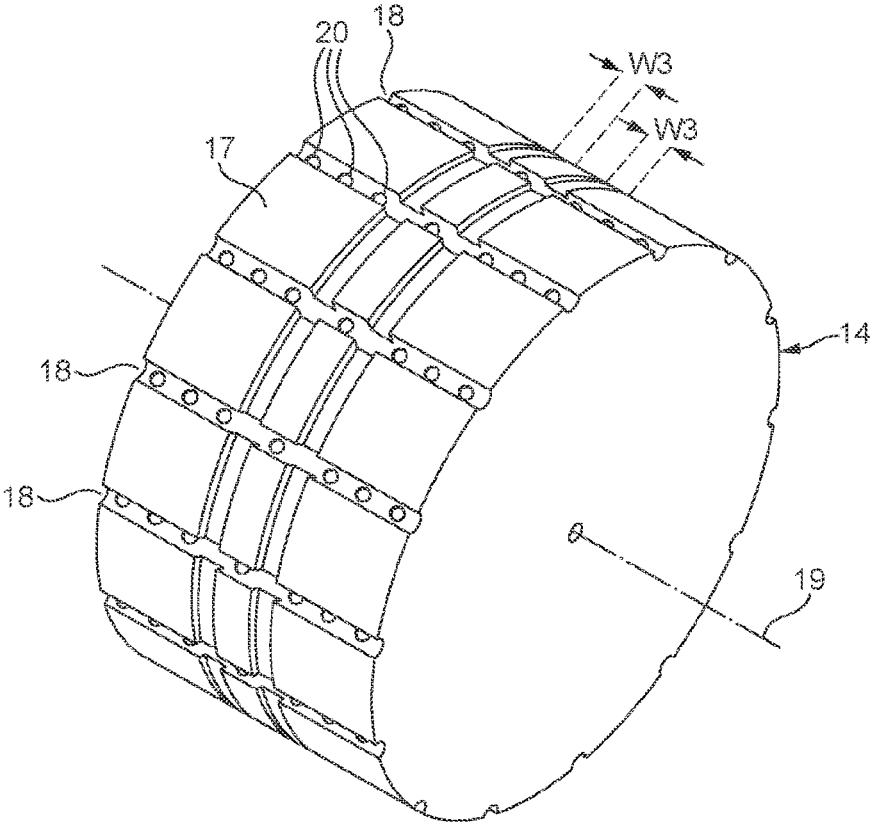
FIG. 8 shows an alternative embodiment of rolling drum for use in the tobacco industry product manufacturing apparatus of FIG. 1.

A rolling drum 14 of a rolling unit 9 of a third alternative exemplary embodiment of the invention is shown in FIG. 8, in which like features in common with the rolling drum 14 shown in FIG. 3 retain the same reference numerals. In this alternative embodiment of rolling drum 14, the curved outer surface 17 includes a pair of spaced channels 33. The channels 33 extend in a circumferential direction of the rolling drum 14, substantially perpendicular to the flutes 18. The channels 33 extend in plane that lies substantially perpendicular to the axis of rotation 19 of the rolling drum 14. The channels 33 have a width 'w3' which corresponds to the length of the second segment 25 of the filter components 6, or which is slightly larger than the length of the second segment 25.

Operation of the rolling unit 9 of the apparatus 1 of the third alternative embodiment of the invention will now be described. The tobacco rods 5 and filter components 6, together with the tipping paper patch 22, are transferred from the tipping drum 8 to the rolling drum 14 as the rolling drum 14 rotates. The channels 33 are positioned on the rolling drum 14 to correspond to the position in which the harder second filter segments 25 are disposed when transferred onto the rolling drum 14. Therefore, the harder second segments 25 are partially received within the channels 33. As the rolling drum 14 rotates, the contact edge 36 of the kicker bar 16 exerts pressure on the tobacco rods 5 and filter components 6 to push them out of the flute 18. Once past the kicker bar 16, the tobacco rods 5 and filter components 6, together with the tipping paper patch 22 are rolled between the curved outer surface 17 of the rolling drum 14 and the curved contact surface 34 of the roll hand 15. At both the point where the kicker bar 16 pushes the tobacco rods and filter components 6 out of the flute, and during rolling between the roll hand 15 and the rolling drum 14, the harder second segments 25 are partially received within the channels 33. This helps prevent the roll hand 15 and kicker bar 16 being pushed away from the rolling drum 14 and disrupting the spacing therebetween, and/or prevents the roll hand 15 and kicker bar 16 damaging the second filter segments 25 through excessive compression during compression and/or rolling. The channels 33 also help enable a similar pressure be applied on all filter components 6 of varying hardnesses during the rolling process to help achieve consistent rolling performance.

It is intended within the scope of the invention that the rolling unit 9 having the rolling drum 14 with the channels 33 formed therein, may be used with any embodiment of roll hand 15 and kicker bar 16 described above. Yet further, is intended within the scope of the invention that the rolling unit 9 having the rolling drum 14 with the channels 33 formed therein, may be used with a roll hand 15 and kicker bar 16 without any recesses 31 or grooves 32 formed therein, that is, a conventional roll hand and kicker bar. In such an embodiment, it will be appreciated that only the channels 33 in the rolling drum 14 partially receive the harder second filter segments 25. In an advantageous embodiment, at least one of the kicker bar 16 and roll hand 15 are provided with respective recesses 31 and grooves 32, as well as the rolling drum 14 having channels 33 therein. In such an embodiment, the harder second filter segments 25 are partially received in spaces (i.e. recesses 31, grooves 32, channels 33) in both the roll hand 15/kicker bar 16 and rolling drum 14. This can reduce the axial distortion or deflection of the aligned tobacco rods 5 and filter components 6 when being pushed out of the flutes 18 and/or when being rolled between the roll hand 15 and the rolling drum 14.

In embodiments where the kicker bar 16 includes recesses 31 and the roll hand 15 includes grooves 32, the recesses 31 and grooves 32 may have a range of difference depths within the scope of the invention. These various embodiments are shown in FIGS. 9A-9E which show schematic cross-sectional views through the roll hand 15 and kicker bar 16 taken along a line extending through the recess 31 in the kicker bar 16 and groove 32 in the roll hand 15.

Figure 9A:
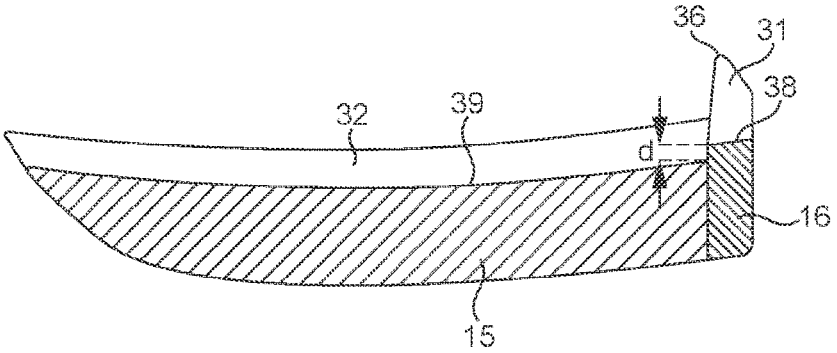
FIGS. 9A-9E show schematic cross-sectional views through the roll hand and kicker bar of further alternative embodiments of the invention.

In one embodiment, shown in FIG. 9A, a base surface 38 of the recess 31 in the kicker bar 16 may be off-set from a base surface 39 of the groove 32 in the roll hand 15, so as not to be level therewith. The off-set is shown as dimension 'd' in FIG. 9A. This may advantageously allow sufficient initial contact with the second filter segments 25 to push them from the flutes 18, but thereafter a reduced contact pressure with the second filter segments 25 during the subsequent rolling process to enable rolling without damaging the second filter segments 25.

Figure 9B:
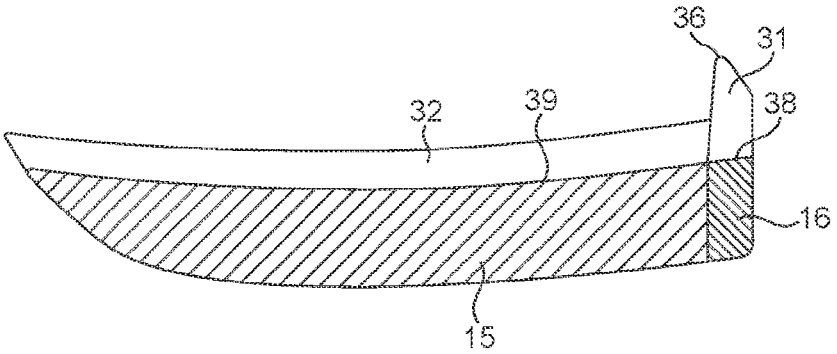
Figure 9C:
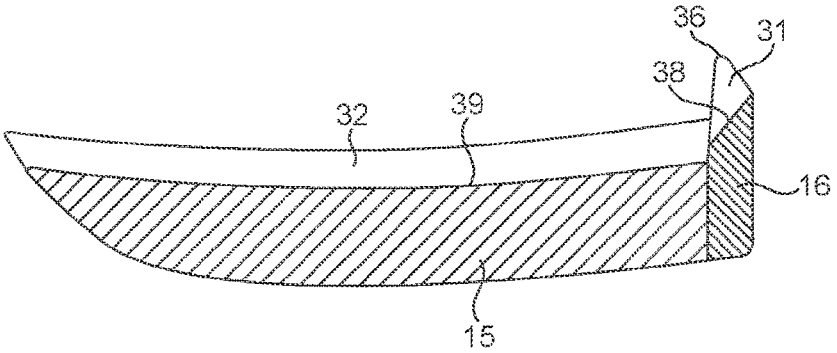
Figure 9D:
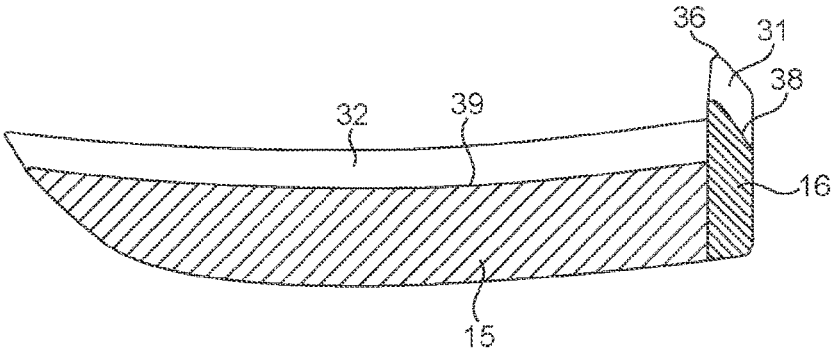

In another embodiment, the base surface 38 of the recess 31 in the kicker bar 16 may be level with a base surface 39 of the groove 32 in the roll hand 15. This may enable the second filter segments 25 to more smoothly transfer to the roll hand 15 from the kicker bar 16. This arrangement is shown in FIG. 9B.

In a yet further embodiment, the base surface 38 of the recess(es) 31 in the kicker bar 16 may be inclined, such that the depth of the recess(es) 31 varies from one side of the kicker bar 16 to the other. As such, the base surface 38 of the recess(es) 31 in the kicker bar 16 may be inclined with respect to the curved surface 17 of the rolling drum 14. The depth of the recess(es) 31 may increase from the side of the kicker bar 16 remote from the roll hand 15 to the side of the kicker bar 16 proximate the roll hand 15, or vice versa. In the former case, illustrated in FIG. 9C, the kicker bar 16 may provide an initial contact with the second filter segments 25 to push them from the flute 18, and as the recess depth increases, the pressure on the second filter components 25 reduces to transition to the roll hand 15. In the latter case, shown in FIG. 9D, the kicker bar 16 may more gently initially contact the second filter segments 25 to avoid damaging the filter segment 25, and may increase pressure on the second filter segments 25 to push them from the flute 18.

Figure 9E:
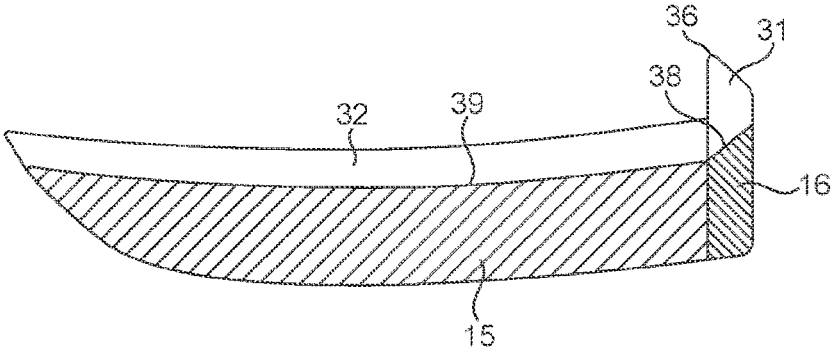

In a yet further embodiment, the base surface 38 of the recess 31 in the kicker bar 16 may be off-set from the base surface 39 of the groove 32 in the roll hand 15 at one side of the kicker bar 16, and may be level with the base surface 39 of the groove 32 in the roll hand 15 at the other side of the kicker bar 16. The base surface 38 of the recess(es) 31 may be off-set from the base surface 39 of the groove(s) in the roll hand 15 at the side of the kicker bar 16 remote from the roll hand 15, and may be level with the base surface 39 of the groove(s) in the roll hand 15 at the side of the kicker bar 16 proximate the roll hand 15, or vice versa. An embodiment of the former configuration is shown in FIG. 9E.

It will be appreciated that the terms 'recess', 'groove' and 'channel' as used herein all refer to features of the rolling apparatus 9 in which a recessed or indented formation is provided in the kicker bar 16, roll hand 15 and/or rolling drum 14 to accommodate less compressible components of the tobacco industry product being manufactured. As such, all such features disclosed herein could be defined as recesses, grooves or channels interchangeably.

As used herein, the term "tobacco industry products" is intended to include smoking articles comprising combustible smoking articles such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles such as e-cigarettes, heating devices that release compounds from substrate materials without burning such as tobacco heating products, hybrid systems to generate aerosol from a combination of substrate materials, for example hybrid systems containing a liquid or gel or solid substrate; and aerosol-free nicotine delivery articles such as lozenges, gums, patches, articles comprising breathable powders and smokeless tobacco products such as snus and snuff.

In one example, the apparatus for manufacture of tobacco industry products described previously is used to make a tobacco industry product that is a smoking article for combustion, selected from the group consisting of a cigarette, a cigarillo and a cigar.

In another example, the apparatus is used to make a tobacco industry product that is a non-combustible smoking article.

In another example, the apparatus is used to make tobacco industry product that is a heating device which releases compounds by heating, but not burning, a substrate material. The material may be for example tobacco or other non-tobacco products, which may or may not contain nicotine. In one embodiment the heating device is a tobacco heating device. The apparatus may alternatively be used to make a consumable for a heating device.

In another embodiment the apparatus is used to make a tobacco industry product that is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment the hybrid system comprises a liquid or gel substrate and tobacco.

The drawings accompanying the various embodiments of the invention described herein are not necessarily illustrated to scale and the dimensions of certain features may be exaggerated for ease and clarity of illustration.

In order to address various issues and advance the art, the entirety of this disclosure shows by way of illustration various embodiments in which the claimed invention(s) may be practiced and provide for a superior tobacco industry rod assembly apparatus. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An apparatus for manufacture of tobacco industry products, the apparatus comprising a rolling unit comprising:

a rotatable drum having a plurality of flutes extending in an axial direction of the drum and spaced circumferentially around a curved outer surface of the drum, the flutes being formed in the curved outer surface of the drum to receive axially-aligned components of a tobacco industry product;

a roll hand having a contact surface facing and spaced from the outer surface of the drum to define a space, between the contact surface and the outer surface, within which space components of a tobacco industry product are rollable across the outer surface upon rotation of the drum; and a kicker bar disposed adjacent to the roll hand and having a contact edge facing and spaced from the outer surface of the drum;

wherein at least one of the roll hand contact surface and the kicker bar contact edge includes a first groove extending in a substantially circumferential direction of the drum and configured to at least partially receive one or more of the tobacco industry product components as the drum rotates; and wherein the roll hand and the kicker bar are held in a fixed position relative to the rolling drum during operation of the apparatus, and wherein the kicker bar is adjustable relative to the roll hand such that the projection distance of a contact edge of the kicker bar from a contact surface of the roll hand can be adjusted and set.

2. The apparatus according to claim 1 wherein at least one of the roll hand contact surface, kicker bar contact edge and drum outer surface includes two first grooves extending in a substantially circumferential direction of the drum, and wherein the two first grooves are spaced apart in an axial direction of the drum.

3. The apparatus according to claim 1, wherein the kicker bar contact edge and the roll hand contact surface both include said first groove.

4. The apparatus according to claim 3, wherein the first groove in the kicker bar contact edge is aligned with the first groove in the roll hand contact surface with respect to a circumferential direction of the drum.

5. The apparatus according to claim 1, wherein the curved outer surface of the drum includes a second groove extending in a substantially circumferential direction of the drum and extending between circumferentially adjacent flutes, the second groove in the curved drum outer surface being configured to at least partially receive one or more of the tobacco industry product components as the drum rotates.

6. The apparatus according to claim 1, wherein the kicker bar contact edge includes the first groove and the roll hand contact surface includes the first groove, and wherein a base surface of the first groove in the kicker bar contact edge is level with a base surface of the first groove in the roll hand contact surface.

7. The apparatus according to claim 1, wherein the kicker bar contact edge includes the first groove and the roll hand contact surface includes the first groove, and wherein a base surface of the first groove in the kicker bar contact edge is off-set from a base surface of the first groove in the roll hand contact surface.

8. The apparatus according to claim 1, wherein the kicker bar contact edge includes the first groove, and wherein a depth of the first groove in the kicker bar contact edge varies from a side of the kicker bar remote from the roll hand to a side of the kicker bar proximate the roll hand.

9. The apparatus according to claim 8, wherein the roll hand contact surface includes the first a groove, and wherein a base surface of the first groove in the kicker bar contact edge is level with a base surface of the first groove in the roll hand contact surface at the side of the kicker bar proximate the roll hand, and is off-set from the base surface of the first groove in the roll hand contact edge at the side of the kicker bar remote from the roll hand.

10. The apparatus according to claim 1, wherein the kicker bar is a separate component to the roll hand and is fixedly secured to the roll hand.

11. The apparatus according to claim 10 wherein a position of the kicker bar relative to the roll hand can be adjusted.

12. A tobacco industry product assembly machine comprising an apparatus according to claim 1.

* * * * *